US005584571A

United States Patent [19]

Chandler et al.

[11] Patent Number: 5,584,571

[45] Date of Patent: Dec. 17, 1996

[54] APPARATUS FOR SIMULATING LIGHTING EFFECTS

[76] Inventors: Vinal D. Chandler, 9 Willey Creek Rd., Durham, N.H. 03824; Thomas L. Edmonds, 2 River Rd., Barrington, N.H. 03825

[21] Appl. No.: 324,752

[22] Filed: Oct. 3, 1994

[51] Int. Cl.[6] ..... F21V 23/00

[52] U.S. Cl. ..... 362/295; 362/186; 362/382; 362/808; 315/200 A; 315/209 R; 446/477

[58] Field of Search ..... 340/331; 362/35, 362/186, 198, 295, 800, 311, 326, 382, 431, 806, 808; 315/200 A, 209 R, 241 P, 241 S; 446/476, 477, 485

[56] References Cited

U.S. PATENT DOCUMENTS

| | | | |
|---|---|---|---|
| D. 26,081 | 9/1896 | Dock | D21/119 |
| D. 61,118 | 6/1922 | Romulus | D26/95 |
| 423,654 | 3/1890 | Amet | 40/414 |
| 749,657 | 1/1904 | Beemer | 446/477 |
| 1,378,839 | 5/1921 | Cregier | 362/190 |
| 1,718,982 | 7/1929 | Rodeck | 446/477 |
| 2,279,077 | 4/1942 | Sundius | 446/477 |
| 2,478,908 | 8/1949 | Edgerton | 340/331 |
| 2,636,314 | 4/1953 | Martinez | 446/477 |
| 3,444,431 | 5/1969 | Goldberg | 315/200 A |
| 3,721,957 | 3/1973 | Reed, Sr. et al. | 340/331 |
| 3,737,722 | 6/1973 | Scharlack | 446/485 |
| 3,753,039 | 8/1973 | Bonazoli et al. | 315/200 A |
| 4,047,150 | 9/1977 | Kelley | 340/331 |
| 4,200,823 | 4/1980 | Keeran et al. | 340/331 |
| 4,369,394 | 1/1983 | Vincent | 315/200 A |
| 4,428,034 | 1/1984 | Seller | 362/295 |
| 4,477,796 | 10/1984 | Kearsley | 340/331 |
| 4,570,924 | 2/1986 | Connelly | 446/485 |
| 4,601,924 | 7/1986 | Birkes et al. | 428/7 |
| 4,866,580 | 9/1989 | Blackerby | 362/800 |
| 4,870,543 | 9/1989 | Born et al. | 362/198 |
| 5,152,601 | 10/1992 | Freng | 362/186 |

*Primary Examiner*—Ira S. Lazarus
*Assistant Examiner*—Alan B. Cariaso
*Attorney, Agent, or Firm*—Michael C. Maier

[57] ABSTRACT

The present invention relates to an apparatus for simulating lighting effects such as an illumination effect necessary to simulate a real life effect for an ornamental display. More specifically, the present invention relates to a light effect which undergoes a number of readily discernable illumination intensities so as to create an illusion of a rotating light beacon which may be used in connection with a lighthouse, control tower, search light or the like. The present invention is quite durable and reliable and economically manufactured and may be positioned readily within a model display.

9 Claims, 3 Drawing Sheets

APPARATUS FOR SIMULATING LIGHTING EFFECTS

BRIEF DESCRIPTION OF THE PRESENT INVENTION

The present invention relates to an apparatus for simulating lighting effects such as an illumination effect necessary to simulate a real life effect for an ornamental display. More specifically, the present invention relates to a cyclable light effect and means for assembling the lighting effect, which may be used in connection with a lighthouse, control tower, search light or the like and which provides a rotating light pattern but yet which is quite durable and reliable and economically manufactured and yet is easy to use.

BACKGROUND OF THE INVENTION

Many types of ornamental displays, such as holiday displays, hobby assemblies or the like have been provided with relatively rigid illumination elements, which yield only modest illumination or unidirectional lighting of the display with which they are connected. This creates some difficulty to the hobbyist in attempting to create and define and even bring to life the illusion which has been assembled, as only a small portion of the model display may be illuminated at any one time. If the hobbyist is trying to create a more realistic impression, i.e. such as the sentinel which guards the coastline for wayward sea going voyagers, then often expensive and complicated circuitry are required to achieve the desired effect of a light source which acts as if were under supervisory control. Moreover, such complicated arrangements may add additional problems during set up and handling of the lighting effects which further confound the hobbyist in attempting to complete the display and obtain the satisfaction the hobbyist is pursuing. Such sophisticated lighting assemblies may also be inordinately expensive, which might cause the hobbyist to have to choose between what additional elements one can afford thereby further limiting the amount and range of the display being created by the hobbyist. Furthermore, even if one were to develop an aesthetically pleasing model assembly, if one does not have the foresight to build the lighting element within the light house or other model, then one typically has difficulty in inserting the light source in the model due to the relatively narrow confines of the model, i.e. the conical cone of a light house. For instance, the fingers of the human hand are often too large to squeeze up inside of a model lighthouse and the hobbyist may have to resort to using elongated objects such as pen or a hanger in an attempt to position the light source within the model. This can lead to displacing the cap or top of the light house, or scratching the simulated windows as well as the frustration met with by the hobbyist in trying to accurately place the light source. However, hobbyist and other assemblers of such displays often seek an illumination effect which will provide both more realistic lighting of the display enabling the greater transgression into the illusion created by the display thereby enhancing the satisfaction of the creator as well as one which is easily operated and assembled and one which will not unduly burden the economics of the display. In addition, a light source positioning means which allows a light source to be retroactively fitted into a preexisting assembly would provide a greater amount of flexibility to the hobbyists in creating the model layout as well as illuminating existing model displays.

SUMMARY OF THE INVENTION

The present invention describes a device which creates a realistic illusion of a rotating light beacon, for instance one in which would be used to simulate the rotating light beacon found in coastal lighthouses, search lights for airport control towers or other ornamental arrangements or constructions, while at the same time being convenient and simple to use as well as one which may be readily and economically manufactured, assembled and positioned.

In accordance with one aspect of the present invention, the desired results of providing an efficient and life like display of a rotating light beacon is obtained by utilizing a self contained unit which is enclosed in a portable, rigid housing and includes means to generate a particular or predetermined lighting sequence which may be repeated upon continued operation of the apparatus. The housing may also contain an internal power supply or may draw the necessary power from other sources. The operation of the invention is controlled through a switching means enabling the formation of a circuit by which to begin the cycling of the lighting effect through a number of readily discernable phases, each of which simulates the operation of a more real life lighting or illumination means.

In another aspect of the present invention, the operation and or simulation of the particular or predetermined lighting effect, the lighting means is provided with a cylindrical cap structure having a number of circumferentially extending rings along one end and a series of longitudinally extending lines which provide magnification of the lighting means, thereby enhancing the range in which the light may be broadcast.

In yet a further aspect of the present invention, the light source may be supported at a point remote from the housing and retained by relatively rigid means which enable the light source to be configured into an number of usable combinations so as to be able to be fed or snaked through the display.

In still a further aspect of the present invention, the light source may cycle through and be held at a predetermined number of intensity levels. The light source is cycled through an initial, intermediate and final light intensity levels, with each level of intensity lasting for a certain predetermined duration. The final intensity being greater than each of the initial and intermediate intensities and the duration period for the final intensity is longer than the duration periods of each of the first and second duration periods. In addition, the intermediate light intensity is greater than the initial light intensity and the second duration is greater than the first duration.

In still yet a further aspect of the present invention, the light source may be positioned within the relatively narrow confines inside the lighthouse, search light or other assembly by means of a positioning element. The positioning means allows a light source to be placed in preexisting model layouts with little or no difficulty.

The invention contemplates other objects, features and advantages which will become more fully apparent from the following detailed description taken in conjunction with the accompanying drawings.

DESCRIPTION OF PREFERRED EMBODIMENTS

Figure 1A:
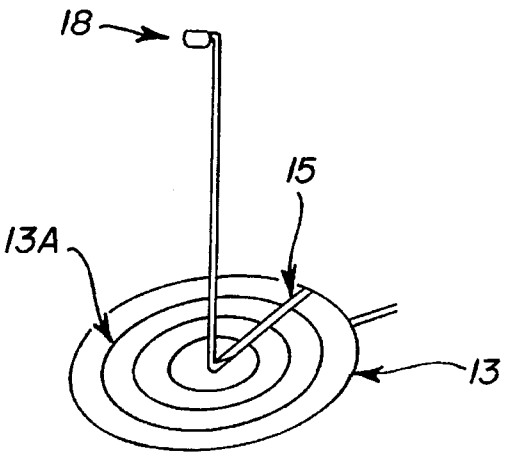
FIG. 1*a* is a front elevational view of the light source positioning means.

Reference numeral 10 generally designates the invention shown in a schematic representation of the illumination means in a lighthouse. The lighthouse shown depicted here in FIG. 1 may include other out buildings 11 which add to the overall effect of the display. Obviously, other outbuildings or topography or the like could be used in connection with the present invention in order to create the particular illusion with which the hobbyist is concerned. The illumination means 10 generally comprises a portable housing 12 constructed of a rigid and light weight material such as plastic or the like, such enclosures may be obtained from Serco Products of Covina, Calif. Connected to the housing 12 are a pair of wires 14 and 16, available from Carol Cable Co., of Pawtucket, R.I., which provide the means for passing the current from the housing 12 to the lighting means 18. The wires 14 and 16 are generally constructed of copper, and covered with an insulative material, however, other conductive material may also be used, such as stainless steel or aluminum. The preferred copper wiring is a 20 AWG grade wire and is provided in several lengths ranging from a few inches to several feet, the length of the wire being determined by the ornamental display in which the assembly is to be used in connection with. For instance, in a lighthouse display as shown in FIG. 1, the length of the wire may be 2.5 to 3 feet in length, whereas a search light may only require several inches in length of wire. A pair of thin copper wires, or other material having similar conductivity, are connected via soldering to the light source 18 LED and to the devices circuit board. The wires may be bent into various orientations with little effort, yet are rigid enough to retain the shape in which they were bent. Thus, the light source may be routed into or around display ornaments of various physical construction with good precision.

Figure 1:
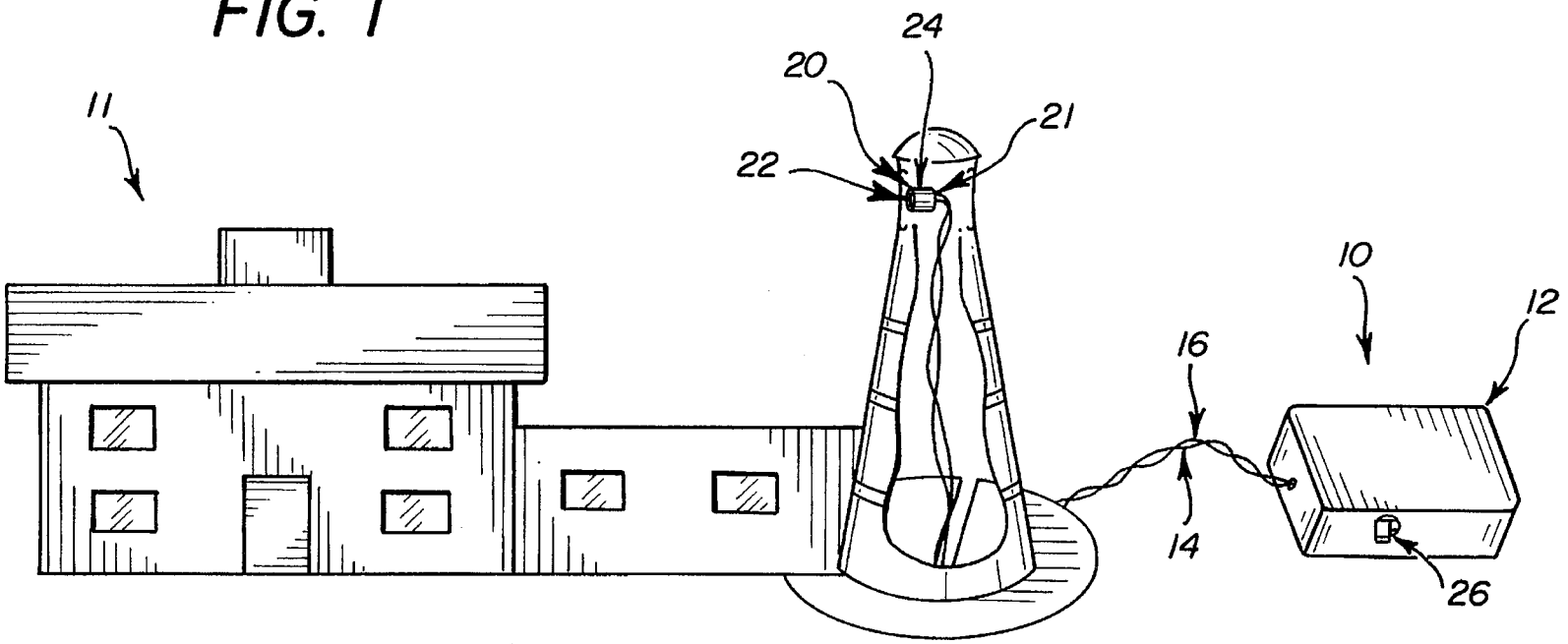
FIG. 1 is a front elevational view of an ornamental lighthouse display having the illumination means and constructed in accordance with the present invention.

Referring now to FIG. 1*a*, the positioning of the light source may be facilitated by use of a light source positioning means 13. Although the light source positioning means 13 is illustrated as circular, any sort of geometric shape, i.e. square, rectangular, etc., may be used to assist in the positioning of the light source within the relatively narrow confines of the light house, search light or the like. The shape of the positioning means usually would be sized and configured to fit the base of the assembly with which the light source is to be used. In each such instance, the positioning means may be trimmed if to large to fit within the assembly. Cutting guides 13*a* may be provided with the positioning means to assist the hobbyist in placing the positioning means and configuring the positioning means to the correct size of the model. In use, the wires 14 and 16 are inserted through a slot 15 so as to be centrally disposed of the positioning means 13. Due to the relatively rigid nature of the wires 14 and 16, the wires may be bent to any sort of desired configuration so that the light source may be readily snaked up inside the light house without the hobbyist having to jam his or her fingers inside. Thus, the light source 18 can be positioned with relative ease inside the light house, without damaging the features of the light house or other model assembly.

Covering the lighting means or light source 18 is a cylindrical cap 20, available from Industrial Devices, Inc., Hackensack, N.J. which has a number of circumferentially extending circles 22 and longitudinally extending lines 24 which serve to magnify the lighting or illumination provided by the lighting means 18. The cylindrical cap 20 is open on one end 21 so as to provide access to the interior of the cap into which the lighting means 18 may be inserted. The cap 20 may be secured to the lighting means 18 by adhesive or the like. The cap 20 may be a plastic, fresnel lens which covers the LED light source 18 and serves to enhance the light output, creating a multiplicity of viewing angle as opposed to a light source if no cap had been provided.

Figure 2:
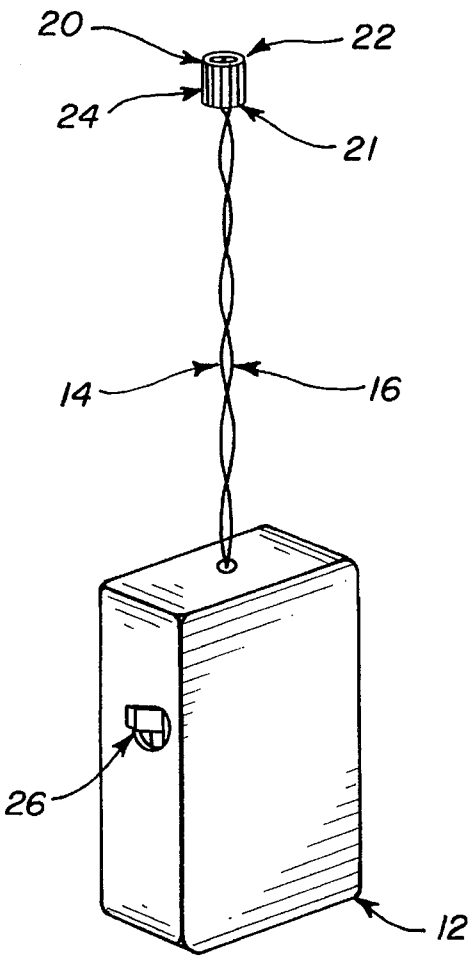
FIG. 2 is a front elevational view of the illumination device and constructed in accordance with the present invention.

Turning now to FIG. 2 is shown the invention 10 comprising the housing 12. In order to activate the device 10, a switch 26 is provided in one of the side panels of the housing 12. The switch 26 may also be positioned in one of the front or back panels of the housing 12, depending on the particular configuration and requirements of the ornamental display 11. The switch 26, available from CW Industries of Southampton, Pa., may also be purchased from Radio Shack, a division of the Tandy Company and is model number 275-327. The switch may comprise a single pole single throw, double throw or double pole double throw.

Figure 3:
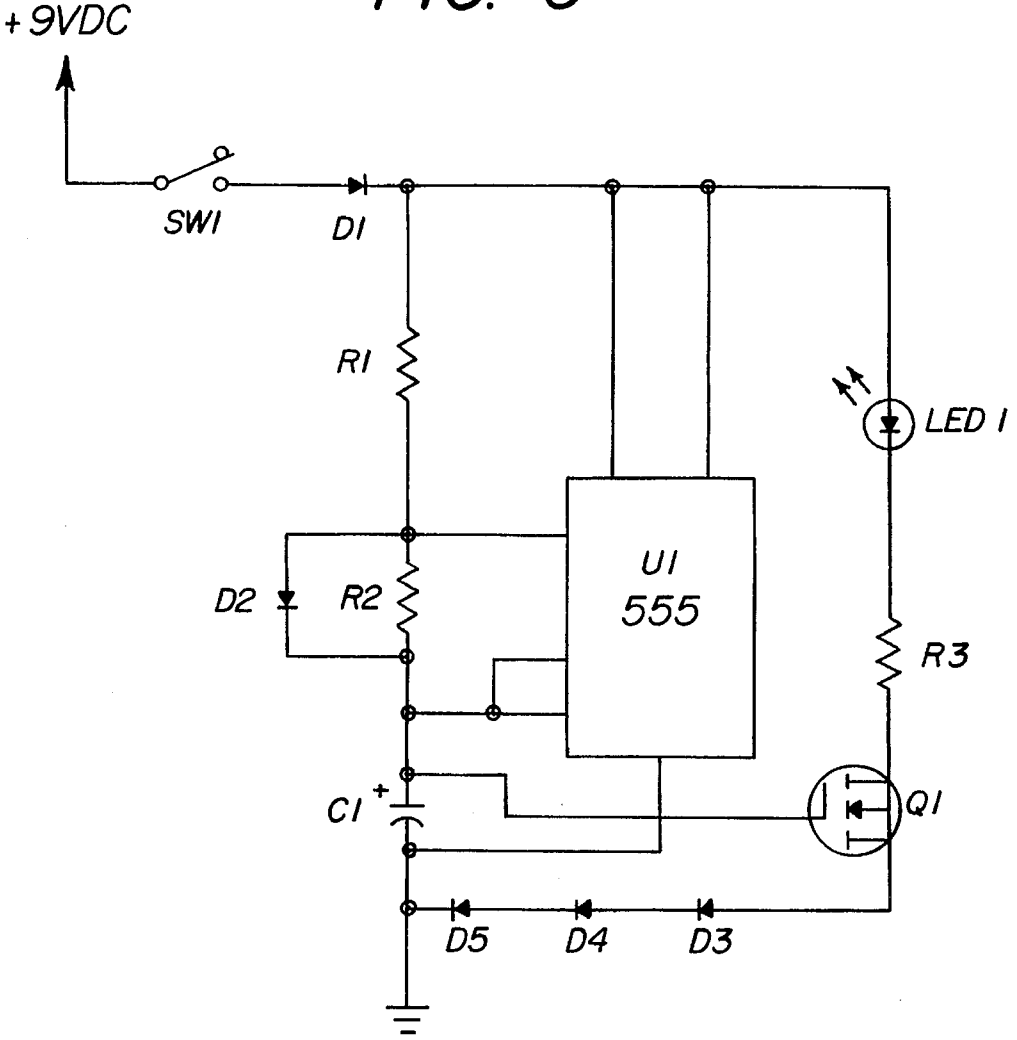
FIG. 3 is a schematic representation of the electrical circuitry of the present invention.

During operation of the device, the light emitting diode (LED) light source 18 is supported by two relatively stiff wires 14 and 16 which supply electric current to the light source 18 from an attached circuit board 30 show in FIG. 3 and power supply (not shown) which is contained within the housing 12. The power supply may consist of a 9 volt battery or other similar means to supply current to the device (not shown). Power is delivered to the circuitry by closing or opening a slide switch 26 which is mounted to the housing 12. The light source 18 is connected to a power source of varying electrical current which is controlled by an electronic oscillator circuit shown in FIG. 3 to be described hereinafter. The electronic oscillator circuit continuously and slowly changes the output light intensity of the light source 18 at a predetermined frequency to give the illusion of a rotating light beacon.

The rate of change of the light output intensity from the light source 18 is controlled by the charging and discharging rate of the capacitor through various resistors R1 and R2 shown in FIG. 3 and an integrated circuit. As the capacitor charges, the electrical potential across the capacitor increases. As the capacitor discharges, the electrical potential across the capacitor decreases. The integrated circuit forces the capacitor to charge and discharge at predetermined time intervals which are directly related to the electrical potential that exists across the capacitor. The resistors control the rate at which the capacitor charges or discharges. A transistor senses the change in electrical potential caused by the charging and discharging of the capacitor and, in turn, varies the current which passes through the light source 18 of the device 10 in direct proportion to the change in electrical potential across the capacitor.

The output of the light intensity of the light source 18 will increase from approximately zero light to maximum light intensity in 3 to 5 seconds. This maximum light intensity represents the final intensity of the light source 18. The light intensity will remain at this maximum intensity for approximately 3 to 4 seconds which is generally longer in duration than the initial or zero intensity or intermediate intensity. The light intensity will then decrease from maximum intensity to approximately zero light intensity in 3 to 5 seconds. The transgression from the maximum or final light intensity to the initial or zero light intensity traverses the intermediate light intensity phase which tends to simulate the rotating away of the light beacon from the side at which the display is being viewed. The light intensity will remain at zero or initial intensity for 1 to 2 seconds which is shorter than the duration of the intermediate or second duration. The described cycle will then repeat. The cycle described above illustrates an exemplary timing cycle for the simulated lighthouse beacon.

Referring now to FIG. 3 diodes D1, D2, D3, D4 and D5 are switching diodes which are generally available from a electronics supply house. Resistors R1, R2 and R3 are 1 Megohm, ¼ watt, having a tolerance of 5% and available from Ohmite of Skokie, Ill. The capacitor C1 is a 10 Microfarad, having a 10% tolerance, with a working voltage of 10 volts DC available from Panasonic of Secaucus, N.J. The transistor Q1 is a Zetex Super E-Line MOSFET available from Zetex Ltd. of Lancashire England. The light emitting diode (LED) is a T-1¾ ultra bright, which may be either yellow, red or green. Other suitable colors may also be selected. An exemplary LED is a Chicago Miniature Brand Lamp model number HLMP-3850 available from Chicago Miniature Co. of Buffalo Grove, Ill.

Figure 4:
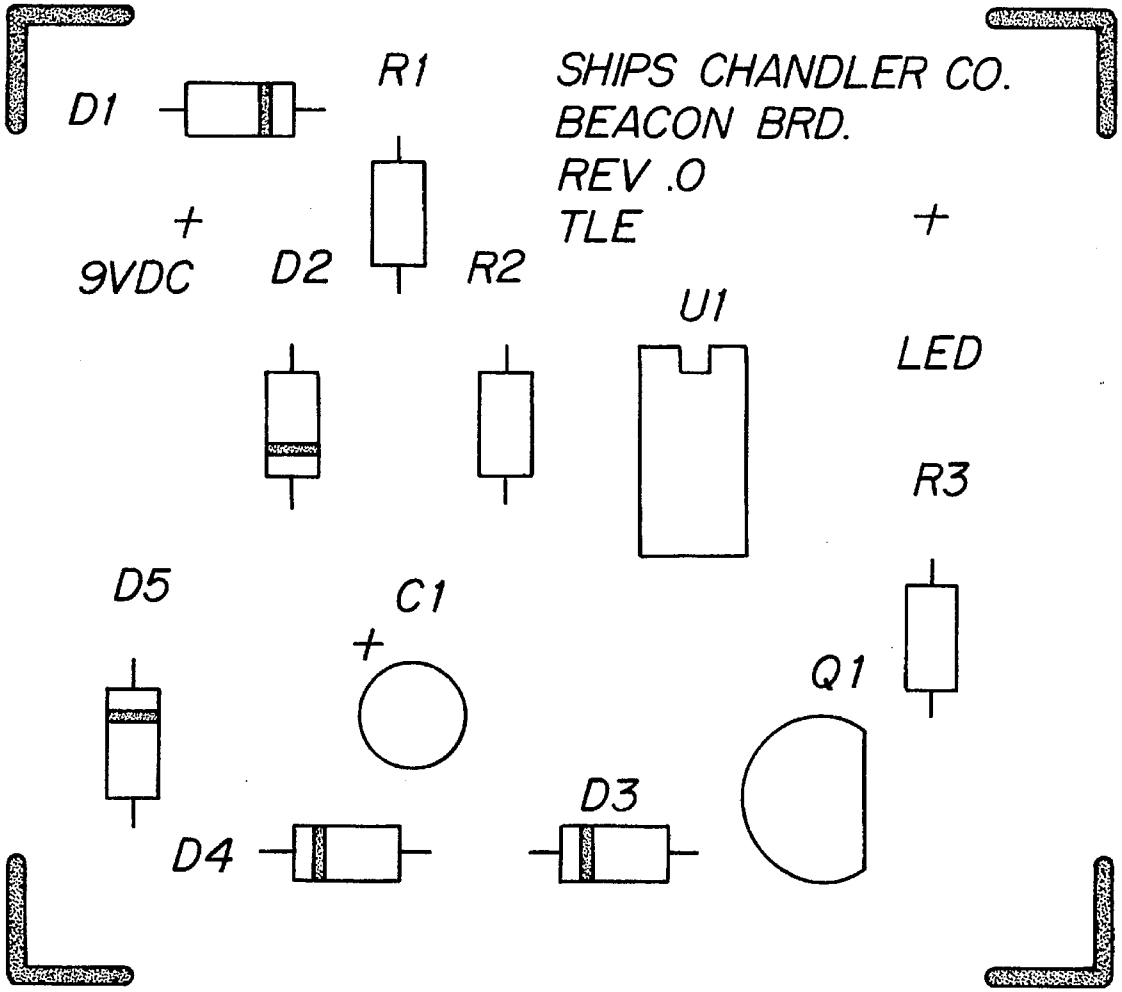
FIG. 4 shows the component placement of the elements on the circuit board.

Turning now to FIG. 4, which illustrates the component side of the circuit board illustrated in FIG. 3 referred to here after as the beacon board. The circuit board measures two inches in width by approximately 1 and ¾ inches in length.

It will thus be seen that according to the present invention a improved illumination means is provided which is readily constructed and operated in a relatively efficient manner and one which is quite durable and economically manufacturable. While the invention has been herein shown and described in what is presently conceived to be the most practical and preferred embodiment thereof it will be apparent to those of ordinary skill in the art that many modifications may be made thereof within the scope of the invention, which scope should be accorded the broadest interpretation of the appended claims so as to encompass all equivalent processes, products and apparatus.

What we claim is:

1. An apparatus for simulating a slowly rotating light beacon, comprising:

a rigid, portable housing;

a switch mounted on said housing a circuit board for providing cyclic control to a light source and mounted within said housing;

a power source contained within said housing and connected to said circuit board;

said light source being connected to said circuit board for cycling illumination intensity of said light source between illumination levels of increasing intensity;

a cylindrical cap covering said light source and disposed on said housing, said cylindrical cap having means for magnifying the illumination from said light source and for providing a multiplicity of viewing angles of said light source; and means for charging and discharging a circuit which continuously and slowly changes the illumination of said light source so as to simulate an illusion of a slowly rotating light beacon.

2. An apparatus for providing a simulative light source as recited in claim 1 wherein the housing is constructed of plastic.

3. An apparatus for simulating a rotating light beacon as recited in claim 1 wherein said means for magnifying the illumination from the light source comprises circumferentially extending rings and longitudinally extending lines in said cap.

4. An apparatus for simulating a rotating light beacon as recited in claim 1 wherein said cap further comprises a fresnel lens.

5. An apparatus for simulating a rotating light beacon as recited in claim 1 wherein said light source positioning means is a circular disk.

6. An apparatus for simulating a rotating light beacon as recited in claim 5, wherein said light source positioning means includes an elongated slit so as to enable wires to be positioned centrally of the positioning means.

7. An apparatus for simulating a slowly rotating light beacon for a light house, comprising;

a light source connected to a power source and a circuit board for continuously cycling said light source through illumination levels of varying intensity;

said light source generating an initial light intensity lasting for a first duration and creating a discernable illumination level;

said light source generating an intermediate light intensity lasting for a second duration and creating a second discernable illumination level;

said light source further generating a final light intensity lasting for a third duration and creating a third discernable illumination level; and wherein said initial, intermediate and final light intensities operating in said first, second and third durations are continuously and slowly charged so as to simulate the slowly rotating light beacon of a light house.

8. An apparatus for simulating a rotating light beacon as recited in claim 7, wherein said final light intensity is greater than each of said initial and intermediate light intensities.

9. An apparatus for simulating a rotating light beacon as recited in claim 7, wherein said third duration is greater than each of said first and second durations.

* * * * *